United States Patent [19]

Shuh-Chin

[11] Patent Number: 4,954,106

[45] Date of Patent: Sep. 4, 1990

[54] AQUATIC SPORTS DEVICE

[76] Inventor: Lin Shuh-Chin, No. 5, 35th Lane, 4th Alley, An-Lo Rd., Chung-Ho City, Taipei Hsien, Taiwan

[21] Appl. No.: 308,130

[22] Filed: Feb. 8, 1989

[51] Int. Cl.[5] ..... B63H 11/02; B63H 16/00

[52] U.S. Cl. ..... 440/21; 440/18; 441/76

[58] Field of Search ..... 440/21, 23, 38, 17–20; 441/76

[56] References Cited

U.S. PATENT DOCUMENTS

| | | | |
|---|---|---|---|
| 453,217 | 6/1891 | Smith | 440/23 X |
| 1,094,184 | 4/1914 | Zimmerman | 440/18 |
| 2,983,244 | 5/1961 | Young | 440/23 |
| 3,479,674 | 11/1969 | Beymer | 440/23 |
| 4,246,861 | 1/1981 | Mikina et al. | 440/23 |

*Primary Examiner*—Joseph F. Peters, Jr.
*Assistant Examiner*—Edwin L. Swinehart
*Attorney, Agent, or Firm*—Ostrolenk, Faber, Gerb & Soffen

[57] ABSTRACT

An aquatic sports device which includes a buoyant body and a water injection device. The water injection device includes a tank, a piston, and a spring. In operation, the user's weight drives the piston downwardly. This causes water to spray out from the buoyant body through a nozzle. The reaction of the sprayed water makes the device move forward through a body of water. The spring returns the piston upwardly when the user takes his or her weight off of the piston.

1 Claim, 1 Drawing Sheet

AQUATIC SPORTS DEVICE

BACKGROUND OF THE INVENTION

1. Field of the Invention

The present invention relates to an aquatic sports device, particularly, one in which the user pedals his or her feet in a skiing motion to draw water into the device at one end and spray water out from the other end of the device, to move the device and the user forward through a body of water.

2. Description of the Related Art

Aquatic sports are very popular. Devices for use in such sports are in demand and are of significant commercial importance. Several such devices have been developed. But the prior art devices are inadequate, and are not suitably designed for users' external physical stature, physical strength, or interest.

SUMMARY OF THE INVENTION

The present invention improves upon the prior art. The present invention provides an aquatic sports device which is both a tool and an interesting toy. With the present invention, a user gets physical exercise while enjoying aquatic sports.

The present invention relates to an aquatic sports device which includes: (A) a buoyant body for buoyantly supporting a user above the surface of a body of water, the buoyant body having a forward end and a rear end; and (B) moving means for moving the buoyant body and the user through the body of water, the moving means including: (a) a tank located within the buoyant body; (b) a first passageway for conveying water from the tank and through the rear end of the buoyant body; (c) a piston which slides downwardly from an upper position within the tank under the weight of the user to force water from the tank, through the first passageway, and through the rear end of the body to move the buoyant body and the user through the body of water; (d) a spring for returning the piston upwardly to the upper position; (e) a second passageway for conveying water from the forward end of the buoyant body and into the tank as the piston is returned to the upper position by the spring; (f) a first one-way valve for preventing water from passing from the rear end of the buoyant body and through the first passageway as the piston moves upwardly; and (g) a second one-way valve for preventing water from passing out of the tank and through the second passageway as the piston moves downwardly.

Other features and advantages of the present invention will become apparent from the following description of preferred embodiments of the invention, with reference to the accompanying drawings.

DETAILED DESCRIPTION OF THE PREFERRED EMBODIMENTS

Figure 1:
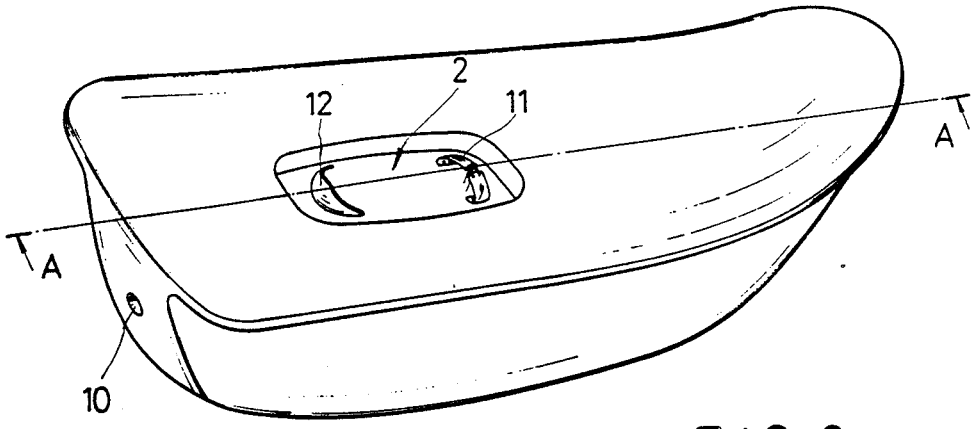
FIG. 1 is a prespective view of an aquatic sports device according to the present invention.
Figure 3:
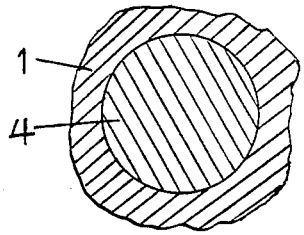
FIG. 3 is a partial cross-sectional view through the line B—B of FIG. 2.
Figure 2:
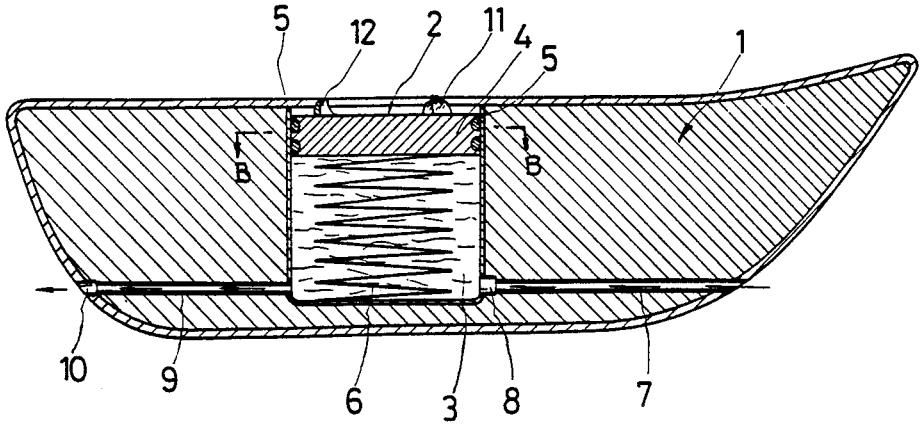
FIG. 2 is a cross-sectional view through the line A—A of FIG. 1.

An aquatic sports device in accordance with the present invention includes a buoyant body 1 and a water injection device 2 for moving the body 1 through a body of water.

The body 1 is made of lightweight material. The outer configuration of the body 1 is streamlined, like a boat.

The water injection device 2 is located at the middle of the rear half of the body 1. The water injection device 2 includes a water tank 3, a piston 4, a seal ring 5, a retractable spring 6, a water-incoming passageway or pipe 7, a one-way valve 8, a water discharge passageway or pipe 9, and a nozzle 10.

The tank 3 has a cylindrical shape with a bottom. The retractable spring 6 is connected to the bottom of the tank 3. The spring 6 supports the piston 4 so that the piston 4 is supported on top of the water tank 3. The piston 4 is a round block. The diameter of the piston 4 matches the inner diameter of the tank 3. An annular slot receives and holds the seal ring 5. The seal ring 5 is in close contact with the tank 3 to prevent water from leading.

The pipe 7 is located at the lower end of the tank 3. The valve 8 is provided at the end of the pipe 7. The valve 8 connects the pipe 7 and the tank 3 so that the pipe 7 only delivers water into the tank 3. The pipe 7 does not discharge water. There may be several of the pipes 7 connected to the lower end of the tank 3 and several of the valves 8.

The rear end of the tank 3 is connected to the pipe 9. A discharage outlet of the pipe 9 is connected to the nozzle 10 so as to facilitate the production of force for pushing the body 1 forward.

In operation, two of the devices are used. The front part of a user's feet are inserted into a telescopic ring 11 provided on the upper end rim of the piston 4. The user's heels are positioned in heel positioning plates 12. With the user's feet properly positioned within the ring 11 and the plates 12, the user can bend slightly at the waist (while in a standing position). The foot that supports the user's weight compresses the retractable spring 6. The resulting pressure of the water within the tank 3 forces water through the pipe 9 so that the water is sprayed out from the nozzle 10. The water sprayed from the nozzle 10 creates a reactive force which makes the body 1 move forward.

Meanwhile, the spring 6 of the other device elongates and pushes the piston 4 of the other device upwardly since no external pressure is applied thereto (substantially all of the user's weight is on the spring 6 of the first device). This creates a partial vacuum inside the tank 3 of the second device to open the one-way valve 8 of the second device to smoothly allow water into the tank 3 of the second device.

Thus, the user simply alternately shifts his or her center of gravity from left foot to right foot, and back again, to discharge water in one direction, to move the user forward in the opposite direction through the water. This skiing motion achieves the dual objects of physical exercise and recreation.

Although the present invention has been described in connection with particular embodiments thereof, many other variations and modifications and other uses will become apparent to those skilled in the art. It is preferred, therefore, that the present invention be limited not by the specific disclosure herein, but only by the appended claims.

I claim:

1. An aquatic sports device, comprising:

(A) a buoyant body for buoyantly supporting a user above the surface of a body of water, said buoyant body having a forward end and a rear end, said buoyant body being formed of lightweight material, said buoyant body having a streamlined outer configuration; and (B) moving means for moving said buoyant body and the user through the body of water, said moving means including:

(a) a cylindrical tank located within said buoyant body, said tank being located more toward said rear end of said body than said forward end;

(b) a first pipe connected to the bottom of said tank for conveying water from said tank and through said rear end of said buoyant body, said pipe including a nozzle located at said rear end;

(c) a circular piston which slides downwardly from an upper position within said tank under the weight of the user to force water from said tank, through said first pipe, and through said rear end of said buoyant body to move said buoyant body and the user through the body of water, said piston including an annular slot;

(d) a spring located within said tank for returning said piston upwardly to said upper position;

(e) a second pipe connected to the bottom of said tank for conveying water from said forward end of said buoyant body and into said tank as said piston is returned to said upper position by said spring;

(f) a first one-way valve for preventing water from passing from said rear end of said buoyant body and through said first pipe as said piston moves upwardly, said one-way valve being located at an end of said first pipe;

(g) a second one-way valve for preventing water from passing out of said tank and through said second pipe as said piston moves downwardly, said second one-way valve being located at an end of said second pipe; and (h) a seal ring for preventing water from leaking from said tank and past said piston, said seal ring being received within said annular slot of said piston.

* * * * *